US006450364B1

(12) United States Patent
Nam

(10) Patent No.: US 6,450,364 B1
(45) Date of Patent: Sep. 17, 2002

(54) DOOR HANDLE OF KIM-CHI STORAGE

(75) Inventor: Jae-wook Nam, Cheonan-shi (KR)

(73) Assignee: Mando Climate Control Corporation (KR)

( * ) Notice: Subject to any disclaimer, the term of this patent is extended or adjusted under 35 U.S.C. 154(b) by 0 days.

(21) Appl. No.: 09/910,939

(22) Filed: Jul. 19, 2001

(30) Foreign Application Priority Data

Jul. 22, 2000 (KR) ..... 2000-42220

(51) Int. Cl.[7] ..... A65D 25/28
(52) U.S. Cl. ..... 220/759; 16/425
(58) Field of Search ..... 220/752, 759; 16/425, 110; 294/34, 31.1

(56) References Cited

U.S. PATENT DOCUMENTS 2,905,500 A * 9/1959 Thombs ..... 220/759
3,157,909 A * 11/1964 Schmitt ..... 220/759
3,305,261 A * 2/1967 Swanke ..... 220/759
3,995,349 A 12/1976 Roberts et al.
4,965,907 A * 10/1990 Baumgarten ..... 220/759
5,170,533 A * 12/1992 Barry ..... 16/425
5,458,186 A 10/1995 Lee et al.
5,584,520 A * 12/1996 Niemeier ..... 220/759
5,659,927 A 8/1997 Shanok et al.
5,988,418 A * 11/1999 Maeshima ..... 220/759

* cited by examiner

*Primary Examiner*—Joseph M. Moy
(74) *Attorney, Agent, or Firm*—Fish & Richardson, P.C.

(57) ABSTRACT

The present invention discloses a door handle of a Kim-chi storage which can simplify an assembly process of a handle, and improve the appearance and touch, by adhering a handle body and a handle cover to a door of the Kim-chi storage. In a container for ripening and refrigerating food such as Kim-chi through the operation of a compressor and a heater, a door handle of the Kim-chi storage includes: a door mounted on an upper portion of the Kim-chi storage body and including a hook hole and a fixing groove with a plurality of bolt holes on at least one side surface of the door; a handle body being positioned at a fixing groove of the door by a hook hooked over a hook hole, and having a plurality of penetration holes corresponding to a plurality of bolt holes; a handle cover having position determination protrusions penetrated and inserted to the penetration holes formed at the handle body and the bolt holes formed at the fixing groove of the door in turn, the handle cover assembled to the handle body by fixing bolts inserted to the inside of the position determination protrusions and fixed to the bolt holes of the fixing groove.

5 Claims, 8 Drawing Sheets

DOOR HANDLE OF KIM-CHI STORAGE

BACKGROUND OF THE INVENTION

1. Field of the Invention

The present invention relates to a door handle of a Kim-chi storage, and in particular to a door handle of a Kim-chi storage in which a fixing groove is formed at the door of the Kim-chi storage by an injection molding process and then the door handle is fixed removable to the fixing groove by a hook and a bolt connection, thereby improving the appearance of the door handle of the Kim-chi storage.

2. Description of the Background Art

In general, a Kim-chi storage is a type of cooling apparatus. A refrigerant is condensed and liquefied under the high pressure by using a condenser driving a motor. The condensed refrigerant is moved to an expansion valve having a tube of a small diameter. Here, the refrigerant is instantaneously vaporized in an evaporator, and thus the temperature is dropped to generate cooling air. The cooling air is supplied to a main body of the storage, thus maintaining the freshness of the food in the storage.

The refrigerant vaporized in the evaporator by absorbing heat is moved from a compressor to a condenser, and condensed and liquefied in the condenser, discharging heat. Thereafter, the above-described procedure is repeated to perpetually perform the cooling operation.

On the other hand, a Kim-chi storage introducing the refrigerating principle to ripen Kim-chi and maintain the freshness of Kim-chi has been popularly used. This Kim-chi storage is assembled as small size. Accordingly, while a general refrigerator has a door at its side portion, the Kim-chi storage has a door on the top surface in a hinge type.

On the interior, it contains a device, which cools and heats the Kim-chi storage. Accordingly, as the Kim-chi ripens, the temperature in the container is increased as the heating device operates and thereby ripens the Kim-chi kept in the container. When the Kim-chi is ripen properly, the heater stops and simultaneously a cooling device is operated.

The temperature of the containing room is maintained properly, thereby capable of maintaining the longevity of Kim-chi through the long term with its taste and freshness.

In order to maintain freshness of Kim-chi and refrigerate Kim-chi, the Kim-chi storage includes a compressor, a refrigerating device for refrigerating the compressor, and other internal devices.

In general, the Kim-chi storage has a top door. Recently, a drawer-type Kim-chi storage has been concocted to insert a drawer-type Kim-chi container into its main body.

As illustrated in FIGS. 1*a* and 1*b*, a Kim-chi storage having a general handle structure includes: a Kim-chi container main body 3 having an upper Kim-chi container (not shown) and a drawer-type Kim-chi container (not shown), which are heat insulated by an insulating material, having an operation panel 5 adhered to its front surface, and having a refrigerating device in its machine room; and an upper door 1 having a handle 2 operated by a hinge for covering the Kim-chi storage main body 3, and a drawer-type door 6.

The conventional handle structure of the Kim-chi storage has the handle 2 formed by an injection molding process as one body to the upper door 1 or drawer-type door 6. Considering the limitation of the versatility to the external appearance of the storage, it is difficult to design the handle to different styles, and assemble the finger hole 4 in convenience to the user.

SUMMARY OF THE INVENTION

Accordingly, the objection of the present invention is to provide a door handle of a Kim-chi storage which can simplify the assembly process of a handle, and improve the appearance and touch, by adhering a handle body and a handle cover to a door of the Kim-chi storage.

In order to achieve the above-described object of the present invention, a container for ripening and refrigerating food such as Kim-chi through the operation of a compressor and a heater, a door handle of the Kim-chi storage includes: a door mounted to the upper portion of the Kim-chi storage body and having a hook hole a fixing groove including a plurality of bolt holes on at least its side; a handle body being positioned at a fixing groove of the door by a hook connected to a hook hole, containing a plurality of penetration holes corresponding to a plurality of bolt holes; and a handle cover having position determination protrusions penetrated and inserted to the penetration holes formed at the handle body and the bolt holes formed at the fixing groove of the door in turn, the handle cover assembled to the handle body by fixing bolts inserted to the inside of the position determination protrusions and fixed to the bolt holes of the fixing groove.

BRIEF DESCRIPTION OF THE DRAWINGS

The present invention will become more elucidated with reference to the accompanying drawings which are given only by way of illustration and thus are not limited to the present invention, wherein.

DETAILED DESCRIPTION OF THE PREFERRED EMBODIMENTS

A door handle of a Kim-chi storage in accordance with a preferred embodiment of the present invention will now be described in detail with reference to the accompanying drawings.

Figure 1A:
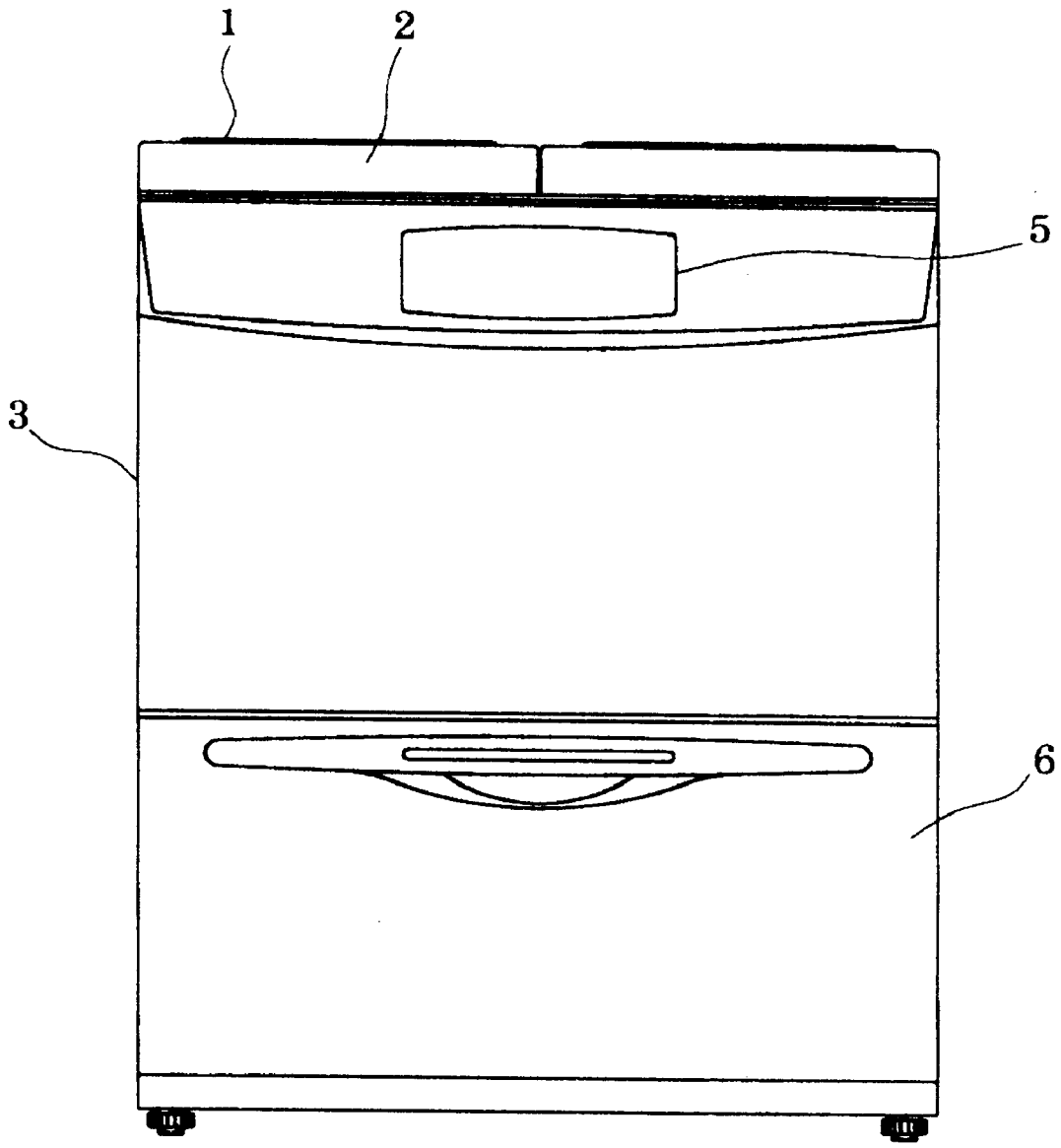
FIG.1a (PRIOR ART)
FIGS. 1*a* and 1*b* are front and side views respectively illustrating an appearance of a Kim-chi storage, for explaining a conventional handle structure of the Kim-chi storage.
Figure 1B:
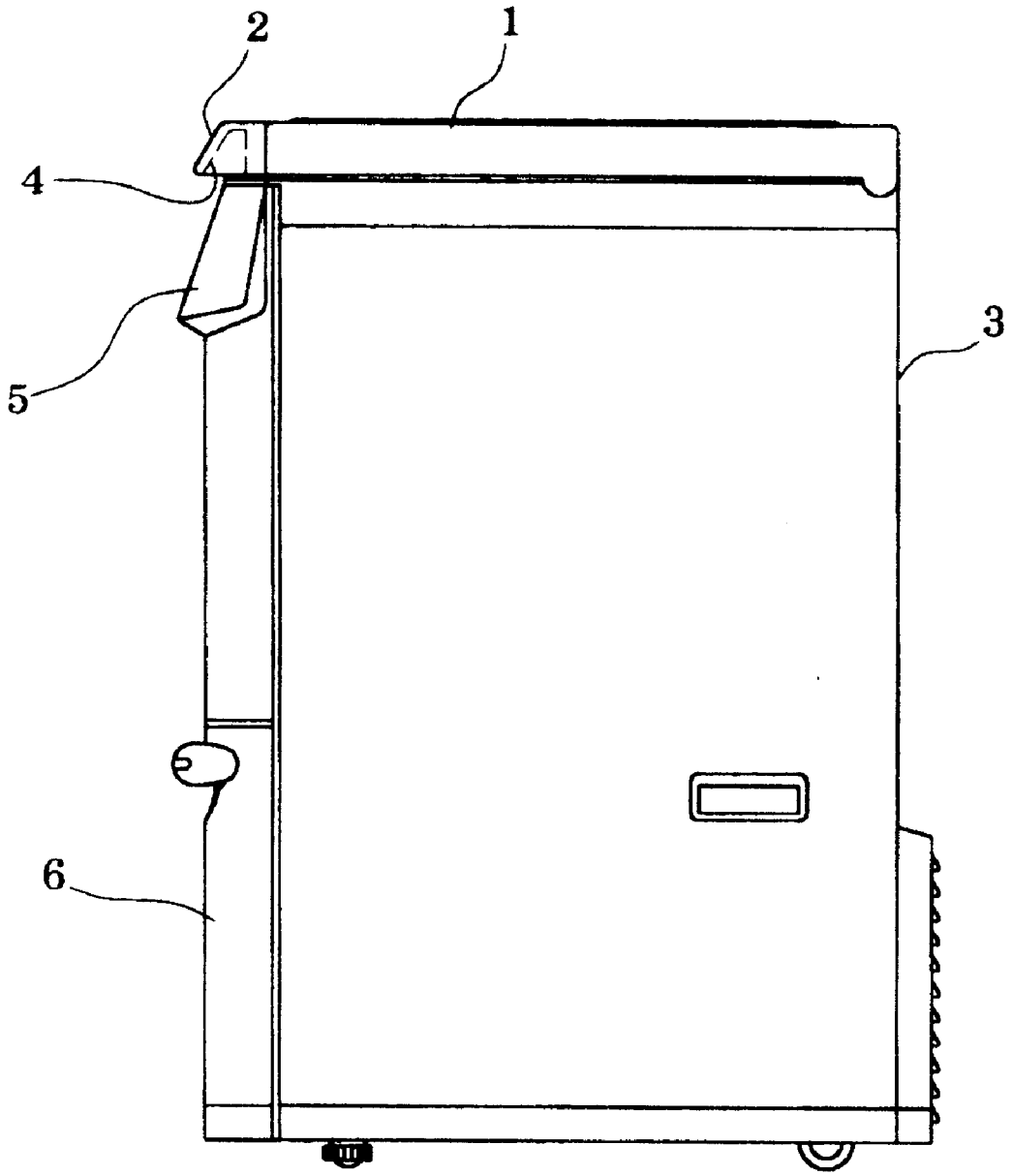
FIG.1b (PRIOR ART)
Figure 2A:
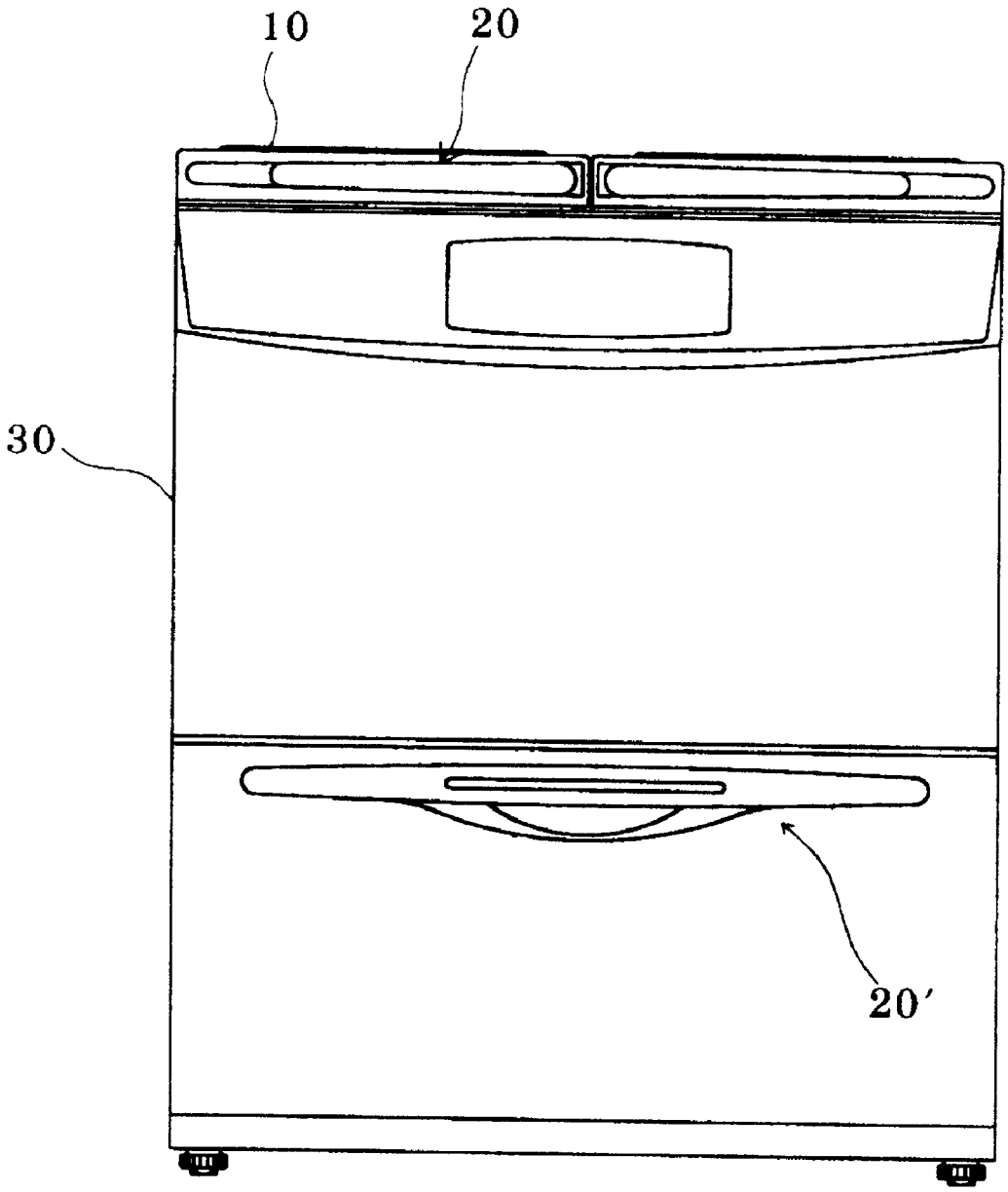
FIGS. 2*a* and 2*b* are front and side views respectively illustrating an appearance of a Kim-chi storage using a door handle in accordance with the present invention.
Figure 2B:
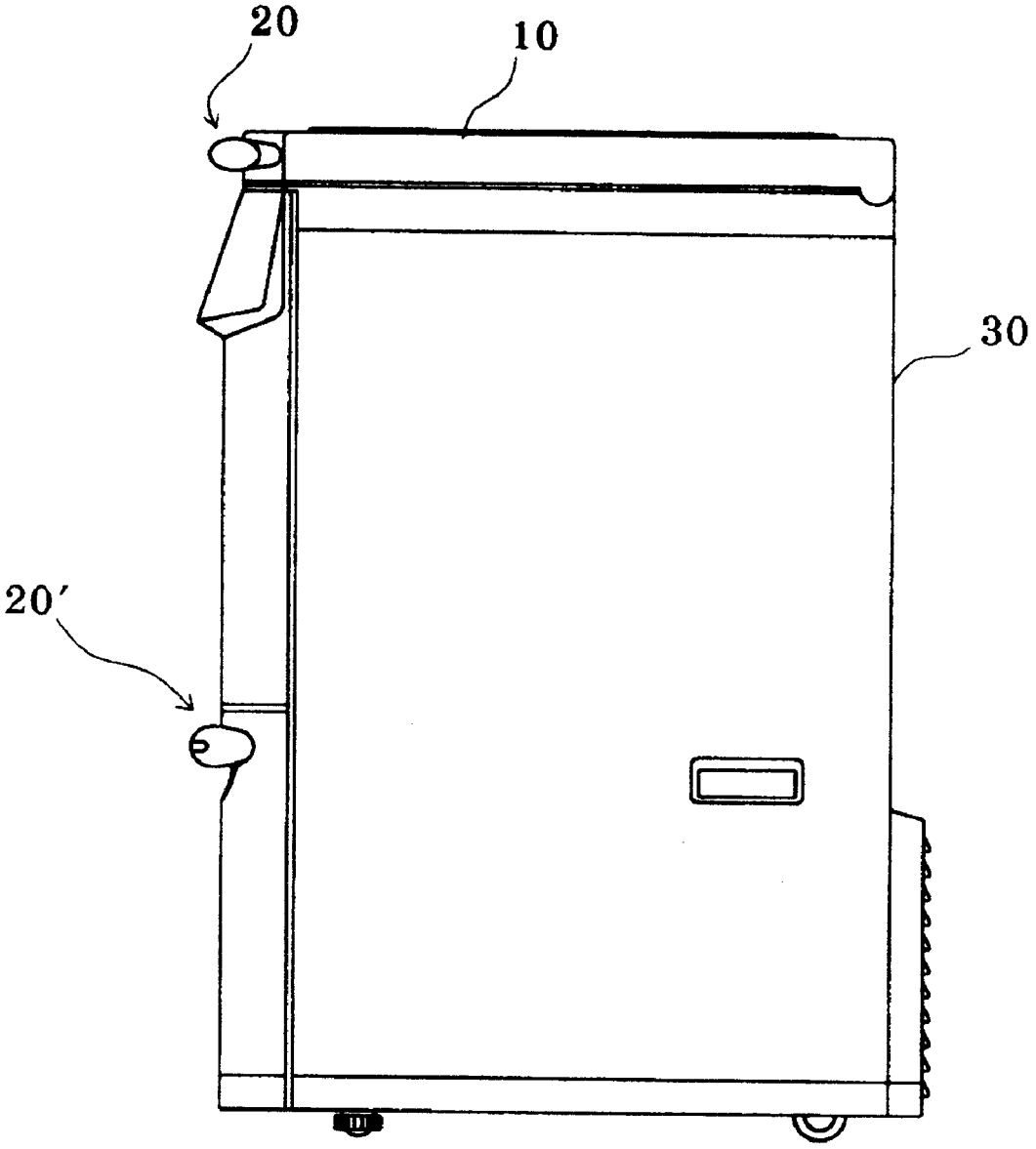
Figure 3A:
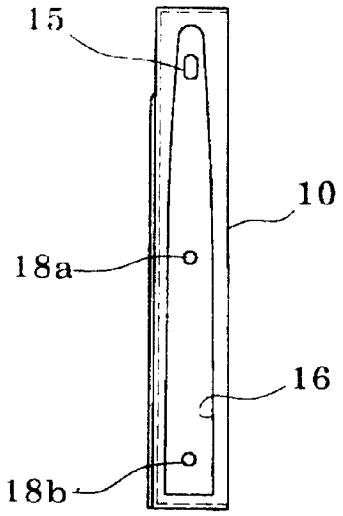
FIGS. 3*a* and 3*b* are side and bottom views respectively illustrating a door of the door handle of the Kim-chi storage in FIG. 2*a;*
Figure 3B:
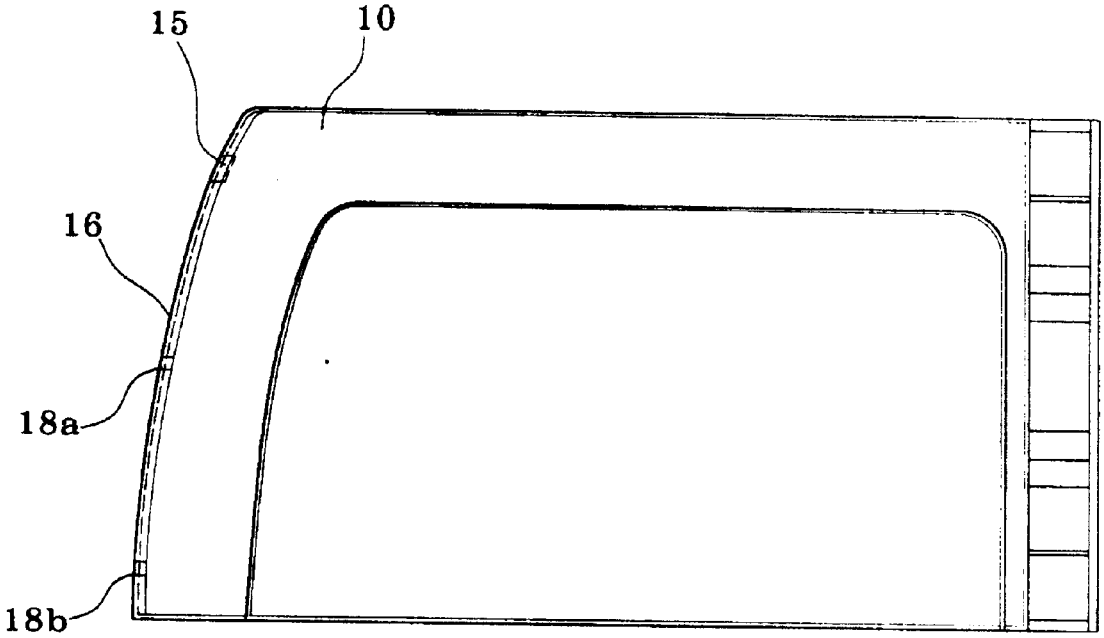
Figure 4A:
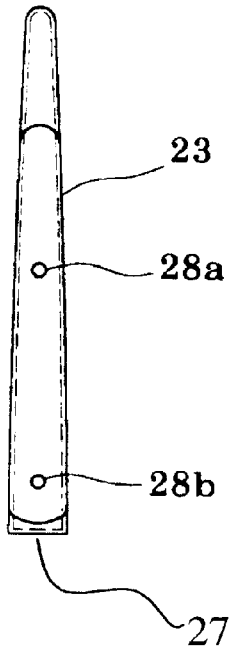
FIGS. 4*a* and 4*b* are front and side views respectively illustrating a handle body of the door handle of the Kim-chi storage in FIG. 2*a;*
Figure 4B:
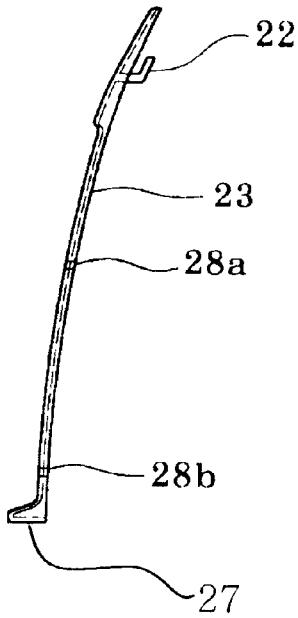
Figure 5A:
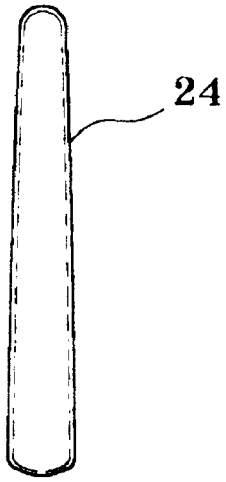
FIGS. 5*a* and 5*b* are front and side views respectively illustrating a handle cover of the door handle of the Kim-chi storage in FIG. 2*a*.
Figure 5B:
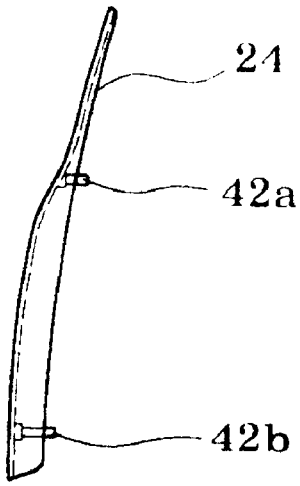
Figure 6:
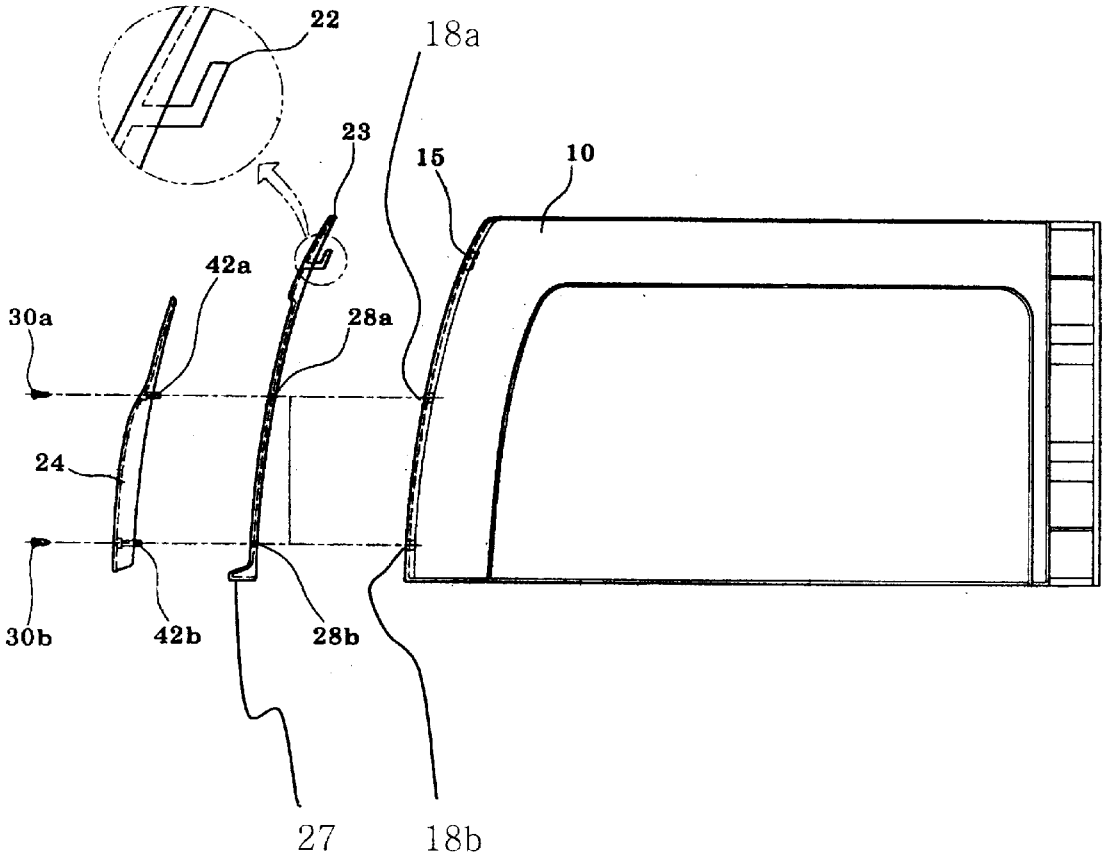
FIG. 6 is a side view illustrating an assembly status of the door handle of the Kim-chi storage in accordance with the present invention.

FIGS. 2*a* and 2*b* are front and side views respectively illustrating an appearance of the Kim-chi storage using the door handle in accordance with the present invention, FIGS. 3*a* and 3*b* are side and bottom views respectively illustrating a door of the door handle of the Kim-chi storage in FIG. 2*a*, and FIGS. 4*a* and 4*b* are front and side views respectively illustrating a handle body of the door handle of the Kim-chi storage in FIG. 2*a*. In addition, FIGS. 5*a* and 5*b* are front and side views respectively illustrating a handle cover of the door handle of the Kim-chi storage in FIG. 2*a*. FIG. 6 is a side view illustrating an assembly status of the door handle of the Kim-chi storage in accordance with the present invention.

Referring to FIGS. 2*a* and 2*b*, the door handle of the Kim-chi storage is applied to a first handle 20 of an upper door 10 operated by a hinge, and a second handle 20' fixed to a drawer-type Kim-chi container. Here, the door handle has a streamline appearance according to an external design of a Kim-chi storage main body 10.

As illustrated in FIGS. 3*a* and 3*b*, the upper door 10 has a hinge unit consisting of a plurality of reinforcing leads for hinge operation at one end, and a fixing groove 16 for forming the first handle 20 at the sidewall of the other end. Here, the fixing groove 16 is positioned by a predetermined depth from the side wall of the other end of the upper door 1, and has first and second bolt holes 18*a*, 18*b* on its bottom surface. The sidewall of the upper door 10 where the fixing groove 16 is formed is bent in a streamline according to the appearance of the Kim-chi storage.

According to a plane shape of a handle body which will later be explained, a width of the fixing groove 16 is gradually decreased from the first bolt hole 18*b* to the second bolt hole 18*a*, and an end of the fixing groove 16 is chamfered. The fixing groove 16 is formed as one body when performing an injection molding of the upper door 10. Here, a hook hole 15 is formed on the bottom surface of the chamfered side of the fixing groove 16, for firmly connecting and precisely assembling the handle body.

As depicted in FIGS. 4*a* and 4*b*, the handle body 23, which is made by the injection molding process, consists of an interior decoration material different from the upper door, and has magnificent patterns such as marble on its surface. Here, various patterns can be formed in plastic formation, by using different kinds of materials. Such patterns are printed on the surface by a general plastic surface printing process.

The handle body 23 has an identical area to the fixing groove of the upper door, and is bent like the fixing groove. Accordingly, the handle body 23 can be inserted into the fixing groove. In addition, a connection portion which is a groove slightly caved in a width direction is formed at the upper portion of the handle body 23, so that a handle cover which will later be explained can be mounted thereon. Especially, first and second penetration holes 28*a*, 28*b* corresponding to the bolt holes of the fixing groove are formed at the connection portion of the handle body 23. A hook 22 connected to the hook hole is incorporated with the bottom surface of the chamfered side of the handle body 23. Here, the chamfered side is formed in a streamline due to gradually-decreased section of the handle body 23. A protrusion unit 27 is upwardly protruded in a streamline shape from the opposite end of the handle body 23.

As shown in FIGS. 5*a* and 5*b*, the handle cover 24 serves as the handle of the upper cover. The handle cover 24 has a convex appearance such as water drops, and is extended in a longitudinal direction with gradually-decreased height. In order for the users to conveniently have access to the upper door, a groove is formed in a streamline shape for the finger contact portion.

The handle cover 24 has the identical patterns to the handle body. Here, first and second position determination protrusions 42*a*, 42*b* having thread holes on their shafts are protruded from the bottom surface of the handle cover 24 for bolt connection.

The assembly status of the handle assembly structure of the Kim-chi storage will now be explained with reference to FIG. 6.

The handle body 23 is positioned in the fixing groove 16 of the upper door 10. Here, the hook 22 of the handle body 23 is hooked over the hook hole 15, and the first and second bolt holes 18*a*, 18*b* correspond respectively to the first and second penetration holes 28*a*, 28*b* of the handle body 23. The handle cover 24 is covered on the connection portion of the handle body 23. At the same time, the first and second position determination protrusions 42*a*, 42*b* of the handle cover 24 pass through the first and second penetration holes 28*a*, 28*b* of the handle body 23, and meet the first and second bolt holes 18*a*, 18*b* of the upper door 10, respectively. The fixing bolts 30*a*, 30*b* are respectively inserted into the position determination protrusions 42*a*, 42*b* for compressing the handle cover 24 to the handle body 23, and fixed to the side wall of the upper door 10.

The door handle of the Kim-chi storage can be conveniently assembled and disassembled. That is, the door handle is disassembled for portability, and easily assembled in installation.

In addition, the door handle of the Kim-chi storage can also be applied to the drawer-type door, as in the upper door described above.

The door handle may be fixed to the door by a plurality of hooks (not shown) having jaws as in bolt connection.

As discussed earlier, the door handle of the Kim-chi storage consists of the handle body and the handle cover which possess a remarkable style through simple hook and bolt processing, and thus improves the shape, touch and quality of the handle of the Kim-chi storage.

Moreover, the door handle of the Kim-chi storage introduces the hook connection structure to minimize a connection recess due to bolt connection, which results in an improved connection status.

The door handle of the Kim-chi storage can be conveniently assembled and disassembled to achieve portability, and is easily assembled in installation.

In addition, the door handle of the Kim-chi storage positions the handle body in the fixing groove of the door, and connects the handle cover to the connection portion such as a groove, thus reducing a connection line in assembly.

As the present invention may be embodied in several forms without departing from the spirit or essential characteristics thereof, it should also be understood that the above-described embodiment is not limited by any of the details of the foregoing description, unless otherwise specified, but rather should be construed broadly within its spirit and scope as defined in the appended claims. Therefore all changes and modifications that fall within the meets and bounds of the claims, or equivalences of such meets and bounds are intended to be embraced by the appended claims.

What is claimed is:

1. In a container for ripening and refrigerating food such as Kim-chi through the operation of a compressor and a heater, a door handle of the Kim-chi storage comprises:

a door mounted on an upper portion of the Kim-chi storage body, with a hook hole and a fixing groove including a plurality of bolt holes on at least one side surface of the door;

a handle body being positioned at a fixing groove of the door by a hook connected to a hook hole, and having a plurality of penetration holes corresponding to a plurality of bolt holes; and a handle cover having position determination protrusions penetrated and inserted to the penetration holes formed at the handle body and the bolt holes formed at the fixing groove of the door in turn, the handle cover assembled to the handle body by fixing bolts inserted to the inside of the position determination protrusions and fixed to the bolt holes of the fixing groove.

2. The door handle according to claim 1, wherein the handle cover has a convex appearance such as water drops in order to cover the fixing groove of the handle body, being extended in a longitudinal direction with gradually-decreased height.

3. The door handle according to claim 1, wherein the handle body and the handle cover is first combined by the hook inserted to the hook hole in an assembled state by the position determination protrusions and thereafter is combined with the fixing bolts.

4. The door handle according to claim 1, wherein a protrusion unit is upwardly protruded from an end of the handle body in a streamline shape.

5. The door handle according to claim 1, wherein various patterns are formed on the surface of the handle body and the handle cover.

* * * * *